US008950352B2

(12) United States Patent
Smith

(10) Patent No.: US 8,950,352 B2
(45) Date of Patent: Feb. 10, 2015

(54) ANCHOR

(76) Inventor: Peter Kevin Smith, Auckland (NZ)

( * ) Notice: Subject to any disclaimer, the term of this patent is extended or adjusted under 35 U.S.C. 154(b) by 104 days.

(21) Appl. No.: 13/620,734

(22) Filed: Sep. 15, 2012

(65) Prior Publication Data

US 2013/0068152 A1 Mar. 21, 2013

Related U.S. Application Data

(60) Provisional application No. 61/535,370, filed on Sep. 16, 2011.

(51) Int. Cl.
*B63B 21/24* (2006.01)
*B63B 21/32* (2006.01)

(52) U.S. Cl.
CPC ..... *B63B 21/24* (2013.01); *B63B 21/32* (2013.01)
USPC ..... 114/301; 114/294

(58) Field of Classification Search
CPC ..... B63B 21/50; B63B 21/22; B63B 21/20; B63B 21/26; B63B 21/29; B63B 2021/262; B63B 21/32; B63B 21/34
USPC ..... 114/293, 294, 301
See application file for complete search history.

(56) References Cited

U.S. PATENT DOCUMENTS

| | | | | |
|---|---|---|---|---|
| 5,511,506 | A | 4/1996 | Bruce | |
| 5,934,219 | A | 8/1999 | Poiraud | |
| 5,970,902 | A * | 10/1999 | Francis | 114/301 |
| 6,390,011 | B1 | 5/2002 | Goodman | |
| 7,111,576 | B2 * | 9/2006 | Francis | 114/301 |
| 7,171,917 | B2 * | 2/2007 | Poiraud | 114/301 |
| D552,526 | S | 10/2007 | Smith | |
| D556,666 | S * | 12/2007 | Mair | D12/215 |
| D684,102 | S * | 6/2013 | Gelb | D12/215 |

FOREIGN PATENT DOCUMENTS

WO WO-2008074107 A2 6/2008

* cited by examiner

*Primary Examiner* — Lars A Olson

(57) ABSTRACT

The invention comprises an anchor including a shank which in cross section along at least part of its length has forward and rearward facing edges and a pair of side faces between said edges. The parts of the shank adjacent the forward edge are substantially "v" shaped in cross section and at least part of the side faces between the edges are concave. The anchor further includes a fluke having a forward end and a rearward edge in normal use, the rearward edge having a continuous flange extending therefrom over at least a substantial part of the rearward edge. The anchor has a roll-bar positioned substantially above the upper surface of the fluke forming a semi-circular wheel spanning the width of the fluke and wherein along at least a substantial part of its length the roll-bar is in cross section substantially in the form of a foil.

19 Claims, 3 Drawing Sheets

Figure 3:
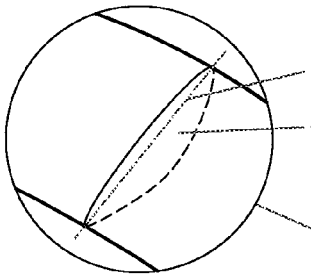

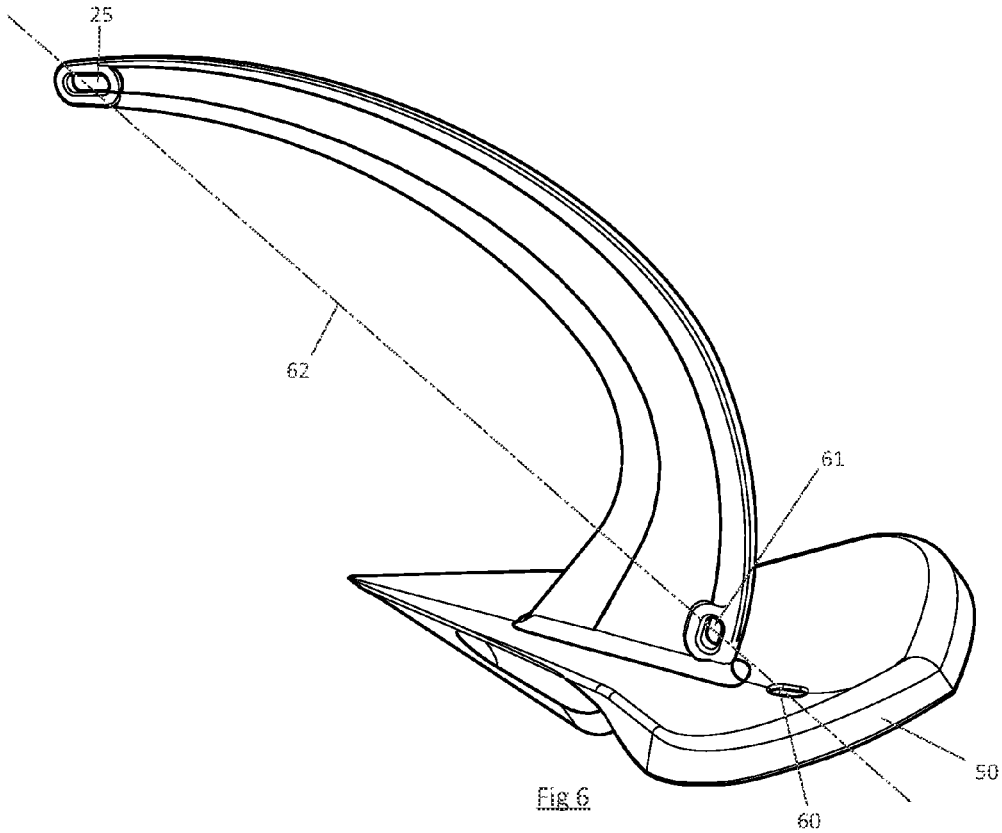
Fig 6
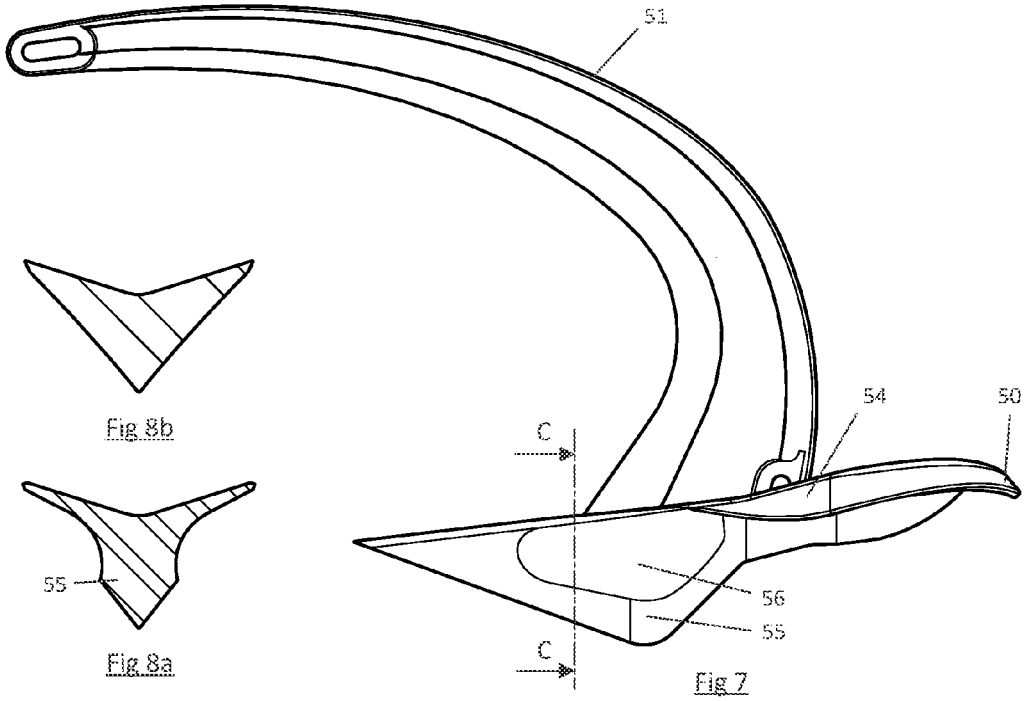
Fig 8b
Fig 8a
Fig 7

ANCHOR

FIELD OF THE INVENTION

The invention relates to An Anchor

BACKGROUND OF INVENTION

The art of marine anchors has progressed to the point where one-sided designs are accepted as superior configurations in the interest of a balance of performance and strength. Anchors of this configuration termed asymmetrical anchors typically have a single fluke with one side of the fluke intended to meet the soil of the seabed. Such anchors have proven to be more efficient than symmetrical designs by way of both setting into the seabed more reliably, and generating a higher resistance for holding on a weight-for-weight basis, whilst being better suited for a construction that is strong and durable. It is also the case that the largest portion of demand is for drag embedment anchors, which are the usual choice for temporary anchoring as opposed to permanent mooring. Because of their nature, asymmetrical drag embedment anchors must necessarily orient themselves, after being dropped onto the seabed, into the correct attitude for which they are designed to set into the seabed in response to a pull on the anchor rode by the anchoring vessel. If this self-orientation does not occur, the anchor may in some circumstances rest on its back or its side and never present its fluke to the seabed. In such cases the anchor fails in its purpose. This self-orientation must be reliable, work across a large range of seabeds, and must also work if the anchor is pulled out of the seabed by way of a reversal or veer of the direction of pull on the anchor rode. Should this occur the anchor is expected to re-set itself without manual intervention. The two main methods of ensuring this self-orientation hitherto have principally been the attachment of a roll-bar to the rear of the fluke or the adding of weight ballast to the tip of the anchor. Other attempts have been made by shifting the position of the shank on the fluke and adding complex protrusions such as fins above the working surface of the rear of the fluke. Such constructions have inherent failings or disadvantages.

The shank of the anchor forms a lever which is subjected to forces applied from the rode attachment point and is therefore vulnerable to deformation or bending at or around the base if the fluke of the anchor is held firmly. This lever is necessary for temporary drag embedment anchors because the fluke must be able be aligned correctly by the rode's pull alone. High forces in normal usage will subject the shank to linear pulls. The highest forces are likely to be when the anchor is being retrieved, and is very well set and buried, or is fouled (stuck) on some obstacle. In this case the vessel may exert extremely high forces in an upward direction on the shank. A problem with existing anchors is that the shank is formed from a variant of either a flat plate with substantially even thickness or a simple I-beam. The former lacks strength on a weight-for-weight basis and the latter restricts burying performance of the anchor. This is clearly disadvantageous.

Also the anchor fluke is vulnerable to bending or deformation in two principle locations: firstly where the shank is mounted and forces from the rode are thereby transmitted, and secondly at the tip which is the first to encounter the seabed and may be subjected to hard rock or other underwater obstacles. This also is disadvantageous.

Another problem relates to performance as measured by setting effectiveness and ultimate holding capacity. The anchor shank and fluke may be constrained by geometry enforced by plate construction methods that result in a suboptimal fluke surface area or higher mass than desirable. In turn this means a less efficient anchor on a weight-for-weight basis. This is disadvantageous to anchoring performance.

Existing anchors that self-right without the use of a roll-bar may make use of fins, modified skids, or other protrusions raised above the fluke surface. These protrusions collect soil from the seabed substrate in which the anchor is used, which may be compacted by the pressure of normal anchoring activity. This can alter the anchor's weight balance to the point it does not self-right as designed if the anchor is later pulled free from the seabed. Without self-righting the anchor cannot be relied upon to re-set. This is clearly disadvantageous.

Other anchors that self-right without the use of a roll-bar may make use of protrusions again extending from the rear or side of the fluke which are intended to interact dynamically with the seabed as the anchor is dragged, providing a rolling moment by way of deflecting soil. These designs do not self-right when the anchor is static but depend upon the proper combination of drag speed and ideal seabed conditions, which is clearly disadvantageous as such a combination may not be counted upon.

Additionally existing anchors that self-right without the use of a roll-bar make use of either a large amount of dead weight as ballast or place the shank impractically far forward on the fluke. The former makes the anchor less efficient on a weight-for-weight basis, and the latter causes both bow-roller compatibility problems and leaves the majority of the fluke unreinforced and subject to damage. These constructions are both disadvantageous.

Existing anchors that self-right by way of a roll-bar have hitherto made use of solid round bar or hollow tube. Solid bar is either too thin to reliably keep the rear of the anchor when upside-down from sinking into a soft seabed, or unnecessarily heavy if made of larger bar diameter. Alternatively a hollow tube may fill with mud entering by way of the openings which cannot be sealed if the anchor is to be hot dip galvanized. Neither method provides any further benefit once the roll-bar has performed its function of orienting the anchor to the correct attitude for setting. This is disadvantageous.

Furthermore anchors may sink some distance into the seabed when the rear edge of the fluke digs into the seabed. This reduces the ability of the anchor to roll into the correct attitude for effective use. Again this is disadvantageous.

PRIOR REFERENCES

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in New Zealand or in any other country.

DEFINITIONS

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

OBJECT OF THE INVENTION

It is an object of the invention to provide an anchor that ameliorates some of the disadvantages and limitations of the known art or which will at least provide the public with a useful choice.

SUMMARY OF INVENTION

In a first aspect the invention resides in an anchor including a shank, the shank in transverse cross section along at least part of the length of the shank having a forward facing edge, a rearward facing edge and a pair of side faces between the forward facing edge and the rearward facing edge, the parts of the shank adjacent the forward facing edge being substantially "v" shaped in cross section and at least part of the side faces between the substantially "v" shaped part and the rearward facing edges being concave on each side face.

Preferably the "v" shape and the concave parts extend substantially the full length of the shank.

Preferably the "v" shaped part extends inwardly of the shank substantially one third of the width of the shank.

Preferably the concave parts of the side faces are positioned so that the shank between the substantially "v" shaped part and the rearward facing edge is substantially in the form of an "I" section along at least a substantial part of the length of the shank.

Preferably the concave areas are curved in transverse cross section.

Preferably the edge of the shank formed by the point of the substantially "v" shape is substantially sharp or is radiused.

In a second aspect the invention resides in an anchor including a fluke having a forward end and a rearward edge in normal use, the rearward edge having a continuous flange extending therefrom over at least a substantial part of the rearward edge.

Preferably the fluke includes side edges between the rearward edge and the forward end, the flange extending onto the side edges.

Preferably the fluke has the upper surface thereof forming a generally concave triangular spoon shape, with the point of the triangle facing forward and the section of the fluke adjacent the point of the triangle having an average thickness of which is greater than the average thickness of fluke adjacent the rearward end of the fluke.

Preferably skids are provided on both sides of the back side edges of the rearward edge of the fluke at an angle between a range of 70 and 110 degrees to the surface of the fluke at the location where the skids meet the rearward edge of the fluke.

Preferably the rear of the rearward edge of the fluke is curved or bent upward.

Preferably the anchor further includes a shank, the shank having a substantially forward facing edge and a substantially rearward facing edge in normal use, the flange and the shank each being curved along their length such that in use the shank and flange co-operate to allow the anchor to rotate about the flange and at least parts of the rearward facing edge.

Preferably the angle between the flange and the fluke at their intersection is between substantially 60° and substantially 120°.

Preferably each side of the back edges of said fluke possess a quasi-elliptical or circular convex profile, and the center of said back edge is located at a point extended behind the sides of the fluke, and a flange is attached to the back of said fluke, said flange extending substantially around the width of the fluke, and a shank, wherein the upper edge of said shank forms a compound curve extending away from a line between the base of the shank and the rode attachment point, along which said flange and said shank edge the anchor may roll if positioned on a flat surface in an upside-down or sideways attitude, said surface always only in contact with one point on said flange and one point of said shank edge such that the relative position of the anchor's center of mass will cause the anchor to rotate until its tip is also in contact with said surface.

Preferably the flange consists substantially of a surface formed by numerous profiles of angles selected from a range of angles, said profiles being coplanar to the seabed or curving away from the seabed in use and forming an average angle of incidence with the seabed in a range of 0 to 30 degrees when the anchor is in such a position that the seabed is in contact with the given profile and the upper edge of the shank.

Preferably the fluke has forward and rearward ends in normal use and being substantially triangular in shape, the fluke having upper and lower surfaces, the upper surface being substantially concave in transverse cross section and the shank extending from the upper surface, the fluke having a downwardly extending bulb on the lower surface positioned at or towards the forward end to provide ballast to the anchor forming a geometry that allows the center of mass of the anchor to be lowered in normal use of the anchor, as far as possible.

Preferably said fluke has a downwardly extending part and said bulb is formed by concavities placed on both sides of the downwardly extending part, which concavities extend substantially along the length of said downwardly extending part.

Preferably the anchor has a shank.

Preferably the fluke has a tip ballast contained within a volume formed on each side of the fluke by a line extending from the tip of the fluke to the outer most extremity of one side of the fluke, the underside front edge of the fluke being at a selected angle to maximize both setting performance and strength.

Preferably the angle is between substantially 15 and substantially 40 degrees from the line of the top center of the fluke's front section, and said line of the top center of the fluke's front section.

In a third aspect the invention resides in an anchor having a roll-bar positioned substantially above the upper surface of the fluke, the roll-bar forming a semi-circular or elliptical wheel spanning the maximum width of the fluke and wherein along at least a substantial part of its length the roll-bar is in cross section substantially in the form of a foil.

Preferably the upper section of said roll-bar takes the form of a foil or wing with the chord of said foil or wing being angled within 40 degrees of parallel to the average surface of the fluke.

Preferably the foil has the surface thereof having the greater radius of curvature facing the fluke.

Preferably the lower surface of the fluke has a rebate extending from the rearward end to a position between the forward end and the rearward end.

Preferably the rebate extends substantially one third of the length of the fluke.

Preferably the rebate extends over substantially the full width of the fluke.

Preferably various attachment points are formed by holes penetrating the shank from side-to-side and said holes are surrounded by a section of shank the thickness of which is equal to the maximum width of the shank profile at that point in the shank's length.

Preferably the base of the shank or a section near it is generally thicker than the rode-attachment end, and said thickness varies between the two ends forming an approximately linear taper.

Preferably a hole is located in the fluke behind the tandem anchor attachment point on the shank so positioned that the center of said hole is near or on an imaginary line from the rode attachment point extending through the tandem anchor attachment point.

Preferably the profile of the base of the shank is higher than the rode-attachment end, and said height varies between the two ends forming an approximately linear taper.

Preferably at least the shank is produced with a HSLA (high strength low alloy) or microalloyed steel or a duplex stainless steel.

Preferably the fluke has a forward end, a rearward end, a lower surface, an upper surface, and a pair of side edges, a rib substantially longitudinal of the fluke on the lower surface of the fluke, and the fluke being substantially concave between the rib and the side edges along at least a substantial part of the length of the rib, the rib extending from the forward end of the fluke towards the rearward end of the fluke for at least one half of the length of the fluke.

Preferably the fluke has a section of deepened profile extending from the forward end of the fluke to a position substantially two-thirds of the length of said fluke, or alternately to such a length that it extends just past the rear extremity of the base of the shank attached above to the upper surface of said fluke.

BRIEF DESCRIPTION

Figure 1:
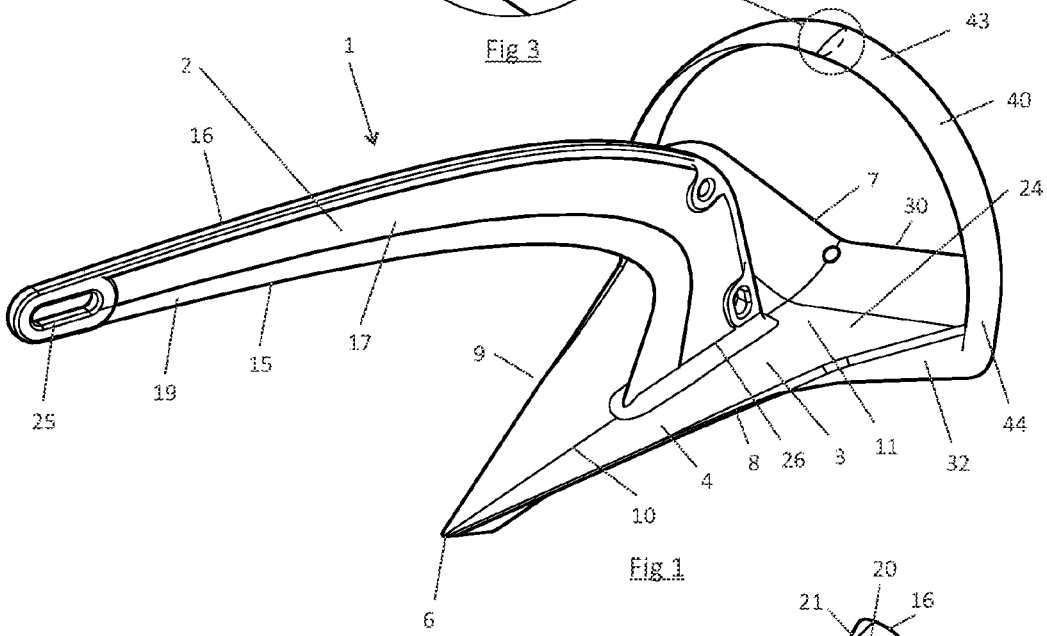
Figure 4:
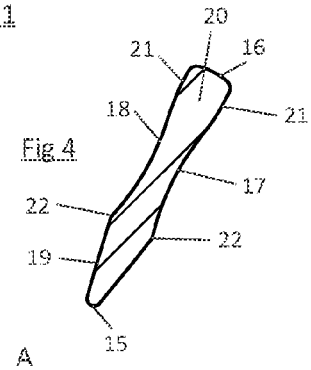
Figure 2:
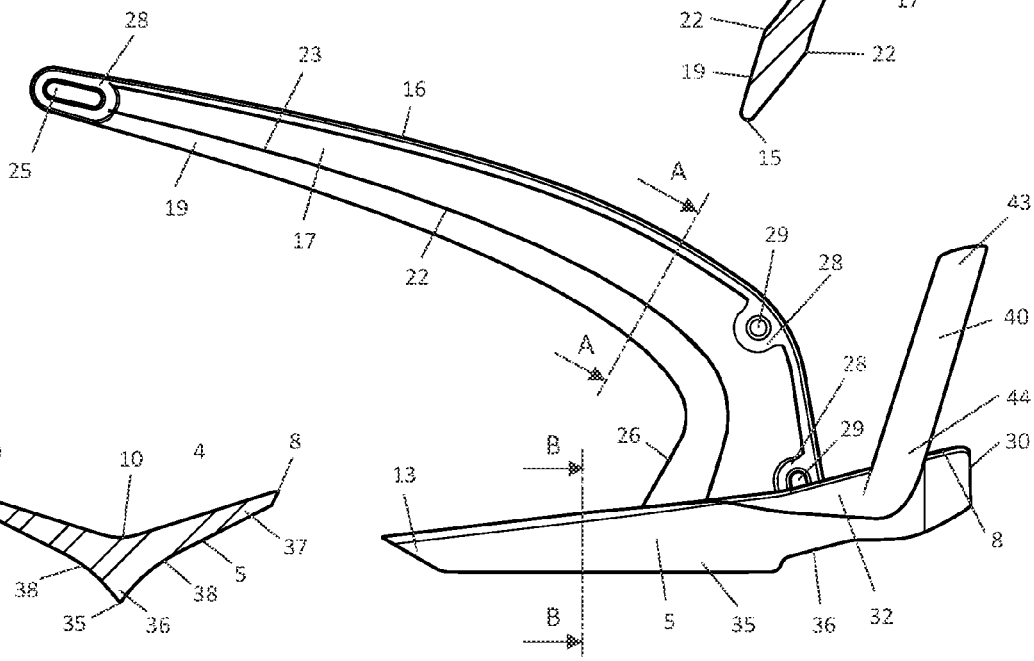
Figure 5:
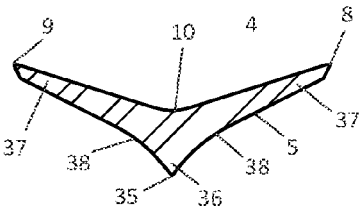
Figure 9:
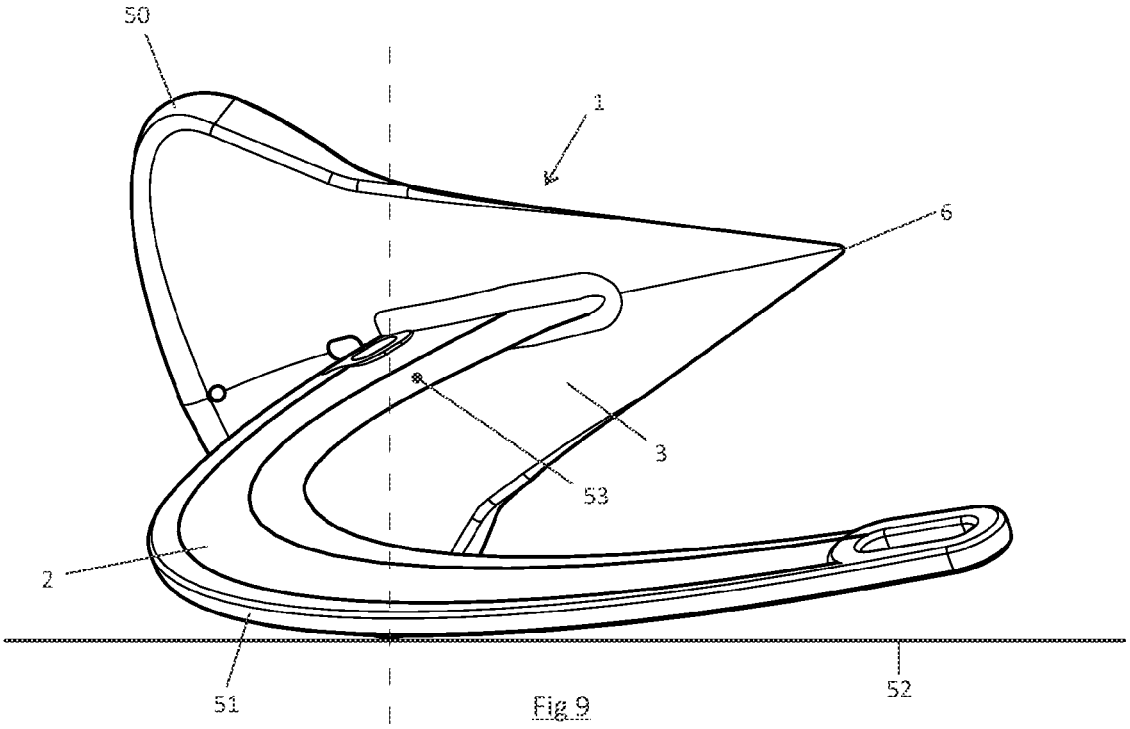
Figure 10:
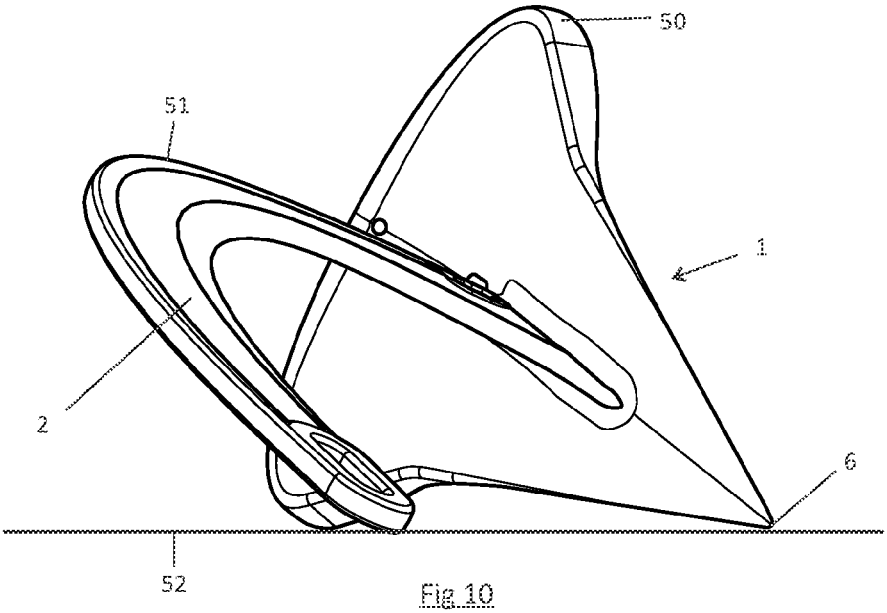

The invention will now be described, by way of example only, by reference to the accompanying drawings:

FIG. 1 is a perspective view of an anchor in accordance with a first preferred embodiment of the invention, FIG. 2 is a side elevation of the anchor of FIG. 1, FIG. 3 is an enlargement of the part circled in FIG. 1, FIG. 4 is a cross section on A-A in FIG. 2, FIG. 5 is a cross section on B-B in FIG. 2, FIG. 6 is a rear perspective view of an anchor in accordance with a second preferred embodiment of the invention, FIG. 7 is a side elevation of the anchor of FIG. 6, FIGS. 8*a* and 8*b* are alternative cross sections on C-C in FIG. 7, and FIGS. 9 and 10 show the embodiment of the invention shown in FIGS. 6 to 8 in a rolling motion.

DESCRIPTION OF THE PREFERRED EMBODIMENT(S)

The following description will describe the invention in relation to preferred embodiments of the invention, namely an anchor. The invention is in no way limited to these preferred embodiments as they are purely to exemplify the invention only and that possible variations and modifications would be readily apparent without departing from the scope of the invention.

FIG. 1 shows an anchor 1 designed for maximal efficiency and holding capacity, and optimal strength.

The anchor 1 includes a shank 2 attached to or combined with a single fluke 3. The fluke 3 has an upper surface 4 and a lower surface 5 as well as a forward end 6 and a rearward end or heel 7. Side edges 8 and 9 extend between the forward end 6 and the rearward end 7. The forward end 6 is somewhat pointed and the rearward end 7 wider so that the fluke 3 is substantially triangular in shape.

The fluke 3 may be "folded" along it longitudinal center line 10 as can be seen in FIG. 5. The angle of the "fold" may be varied to suit conditions and needs but I have found that an included angle of about 145° is satisfactory.

The upper surface 4 is also desirably concave particularly in the area 11 towards the rearward end 7. Thus the upper surface 4 is somewhat of a concave and triangular spoon shaped configuration.

Along at least part of the length and substantially the full length of the shank 2, the shank 2 in transverse cross section (A-A) is shaped such that the shank 2 has a forward facing edge 15, a rearward facing edge 16 and a pair of side faces 17 and 18 between the forward facing edge 15 and the rearward facing edge 16. The parts 19 of the shank adjacent the forward facing edge being substantially "v" shaped in cross section and at least part of the side faces 17 and 18 between the substantially "v" shaped part 19 and the rearward facing edges being concave on each side face 17 and 18. The concave side faces 17 and 18 do not have any substantial change of curvature along their length as can be seen in FIG. 5.

In a preferred construction the upper or outer two-thirds of the shank 2 forms an I-beam shape with concave walls 17 and 18, and with a V section 19 forming the lower or inside one-third. The upper cross-bar part 20 of the I-beam shape has flat exterior side wall parts 21 of a selected height whilst the lower cross-bar of same may be laterally terminated in a point or radius 22 with no flat sidewalls.

The I-beam profile of the upper or outer two thirds of the shank 2 thus provides for greater efficiency of strength on a mass-for-mass basis when compared to a flat plate or an otherwise un-profiled bar, particularly when the anchor 1 is subject to normal linear pulls. The construction also permits a wider profile for the same mass which provides for greater lateral strength giving better resistance to sideways bending forces. The upper cross-bar of the I-beam profile is subject to compression while the lower is subject to tension during the aforementioned linear pulls; therefore the larger upper arm and smaller lower arm described above is the optimal arrangement.

The V profile given to the lower or inner edge 15 of the shank 2 minimizes resistance created by the shank 2 when burying into the seabed. The concave walls 17 and 18 of the I-beam profile further provide for smooth flow of soil or sand along the sides of the shank with minimal resistance, thereby giving enhanced performance with regard to setting or burial of the anchor in the seabed.

The shank 2 is optimized to best resist loading, for example during retrieval of the anchor, while also performing normally at other times. Accordingly the profile height of the anchor shank varies with a decreased height at the rode attachment point 25 and an increased height toward or at the shank base 26. The lower arm 23 of the "I" beam forming the shank reduces in arm height along its length towards its extremity to nil or close thereto. This allows the material of the "I" beam to be reduced but retains sufficient strength in the shank as the lower part of the shank is in tension while the upper part of the shank is in compression during any expected linear high loading.

The I-beam profile gives maximum strength in the areas required.

The shank 2 is further refined with a varied thickness, being generally thinner at the rode-attachment point 25 and thicker at or toward the shank base 26, forming a linear or substantially linear taper in the maximum thickness or width of the shank section along the majority of the shank's length. This taper may proportionately scale the width of the entire shank profile, or the inner extremities of the I-beam profile concavities may remain a substantially constant distant apart while the outer extremities vary their thickness instead.

The bending moment of a beam is proportionate to the square of the beam's thickness, so this lateral taper further optimizes strength by providing greater thickness and therefore strength at the sections nearest the shank base which are at greatest risk of bending.

The arcuate shape of the shank 2 generally takes the form of a crank, which allows the bulk of the shank to be offset from the fluke so permitting the setting process to be well underway before the shank must introduce a level of adverse resistance as it collides with the seabed. This crank is also so-designed to permit the secure storage of the anchor on the bow roller of a vessel: the crank should reverse the inner edge 15 of the shank 2 such that said edge running from the rode attachment point 25 curves through an extremity at the shank crank then runs toward the tip of the fluke 6, creating a forward edge to the base of the shank in an angle that is obtuse relative to a line from said tip to the forward edge of the bottom of the base of the shank. This creates a large-scale notch in which a bow roller may rest, so minimizing vertical movement of the anchor in rough seas.

The shank 2 provides several attachment points, or at least a rode attachment point 25. These attachment points require reinforcement in order to transfer force loadings into the shank evenly with minimal focusing of stress. The attachment points may therefore be surrounded by a section 28 wherein the width of the shank is held at the maximum width of the shank's profile at that point in its tapered length. The depth of these sections may be roughly equal in width to the width of the respective hole or slot 25, 29. Each such section thus forms an eye merged with the body of the shank appropriate for attachment of shackles, swivels, or other fittings.

The shank is preferably formed by either casting, forging, or hot isostatic pressing using a metal that exceeds a yield strength of 400 MPa.

The rearward edge or heel 7 has a straight or convexly curved edge 30. The heel 7 is thinner in section to the average thickness of the rest of the fluke 3, as both weight and strength is more desirable toward the tip or forward end 6. To either side of the heel 7, flanges 32 form substantially flat surfaces extending from each side edge 8 and 9 which drop below the plane of the fluke 3 at that point, forming skids which keep the back of the fluke 3 raised by deflecting the seabed material downward when the anchor is dragged. This allows the forward end 6 to bury whilst holding the heel 7 up, consequently rotating the anchor into the desired upright attitude.

The fluke 3 includes a rib longitudinal of the fluke 3 on the lower surface of the fluke 3, and in the preferred form of the invention the fluke 3 is substantially concave between the rib and the side edges along at least a substantial part of the length of the rib.

To this end the fluke 3 in the embodiment shown in FIG. 2 may possess a centrally thicker area and a central rib 35, which is formed by a profile (B:B) featuring a deepened central section 36 joined to thinner sections 37 by curved profiles which form concave surfaces 38 on either side of the rib 35. This shape moves mass away from the fluke edges 8 and 9 toward the center for optimal ballast placement and thus performance. Thus the matter of anchor fluke vulnerability to bending or deformation in the two principle locations discussed above are ameliorated by this optimization of mass placement which further serves to concentrate strength in the fluke away from the outer edges and toward the central axis and the tip where it is most necessary.

The rib 35 preferably runs a length of about two-thirds of the length of the fluke 3, in any event terminating before or at the forward edge of the heel 7, so keeping weight toward the forward end or tip 6 of the fluke 3 where weight is desired and away from the heel 7. In any event, the rib 35 should extend a little past the canter of the shank base 26, and may taper out at 36 gradually into the heel 7 past the rear extremity of the shank base 26, providing the benefit of its reinforcement to the area of the fluke 3 to which the shank 2 is attached or combined.

The anchor 1 further includes a roll-bar 40 positioned substantially above the upper surface 4 of the fluke 3. In the preferred form of the invention the roll-bar 40 is in cross section substantially in the form of a foil and the foil has the surface thereof having the greater radius of curvature facing the fluke 3.

Thus fluke 3 may have attached to its heel 7 the roll-bar 40 on which the anchor 1 will roll in order to self-right. Hitherto round hollow tube has been used to form this roll-bar, giving a circular transverse profile. In the present invention, this roll-bar 40 shown in FIG. 3 forms a foil or wing 41 with the chord 42 between the leading edge and trailing edge of said foil or wing substantially parallel with the central axis of the fluke 3.

In use this foil shape will deflect soil in the desired direction when the anchor 1 is dragged. By the principle of lift this will firstly assist in keeping the rear 7 of the fluke 3 from sinking in soft seabeds when the anchor is upside-down and has not yet self-righted and secondly will encourage the anchor to bury more deeply when upright and setting.

The foil shape is only required in the parts 43 of the roll-bar likely to contact the sea bed in use, usually the top section with reference to the anchor in the orientation shown in FIG. 2, and may merge into an elliptical shape 44 in order to minimize resistance to mud flow around the roll-bar in the sections closer to the fluke. This construction minimizes the fouling effect of the roll-bar whereby mud or sand is undesirably retained at the back of the fluke and does not flow through or around, thereby interfering with the rest of the fluke's behavior.

The use of a solid roll-bar, as opposed to hollow tube, also avoids problems present in the prior art when the anchor is manufactured of hot dip galvanized steel: such hollow tube must be left open to allow for the HDG process, and during use this permits the entry of water and mud to the inside of the roll-bar where it may remain and eventually cause corrosion damage to the interior.

In further preferred embodiment shown in FIG. 7, the anchor is made to self-right and attain the correct attitude for setting by way of a flange 50 at the rearward end of the fluke 3 along which the anchor will roll even when deployed on a soft seabed. The flange 50 works in conjunction with the shank 2, which must have an outside curve 51 also designed to permit the anchor to roll. Thus the rearward edge 7 of the fluke 3 may have a continuous flange 50 extending therefrom over at least a substantial part of the rearward edge 7. The flange 50 preferably extends onto the side edges 8 and 9 at least a short distance as shown in FIG. 7.

The shank 2 is curved along its length such that in use the shank 2 and flange 50 co-operate to allow the anchor 1 to rotate about the flange 50 and at least parts of the outside curve 51 of the shank 2. By suitably proportioning the length and depth of the flange 50 and the shape of the shank 2 either the shank 2 or the flange 50 can be in contact with the seabed during the full or almost full rotation of the anchor in use.

Typically in this construction the angle between the flange and the fluke at their intersection is between substantially 60° and substantially 120°.

In use then the anchor 1 may then roll on a flat surface when finding itself in an upside-down or sideways attitude as shown in FIG. 9. As the combined geometry is such that the seabed surface 52 is always only in contact with one point on the flange 50 and one point on the shank edge 51 with the anchor's center of mass 53 always offset from the plane defined by these two points, the anchor 1 will rotate until its forward end 6 is also in contact with the surface 52 and the anchor 1 thus ready to be set (FIG. 11).

The anchor 1, when dropped onto the seabed 52 in an upside-down or sideways attitude, will therefore be able to self-right itself without the use of either a roll-bar or other undesirable protrusions above the rear of the fluke, an unnecessarily large amount of ballast in the tip of the fluke, or a shank mounted impractically close to the forward end 6 of the fluke 2.

A moderate amount of ballast added to the fluke adjacent the forward end 6 may be added if necessary in order to provide sufficient counter-weight to shift the center of mass far enough toward the forward end 6. The ballast can be added in the form of a bulb 55 at the bottom of the fluke 2, as shown in FIG. 8*a* or a deepened section or an added insert substantially as shown in FIG. 8*b*. Other cross sectional shapes could be used but it is desirable that the shape is such that the added ballast will easily pass through a mud or similar seabed. The bulb 55 as seen in FIGS. 7 and 8*a* may have concavities 56 on each side thereof.

The bulb ballast is constrained within an imaginary pyramidal geometry formed on each side of the fluke by a line extending from the tip of the fluke to the outer most extremity of the side of the fluke, the underside front edge of the fluke being at an angle chosen to be suitable for both setting performance of the anchor and strength and preferably measures 15 and 40 degrees from the line of the top center of the fluke's front section, and said line of the top center of the fluke's front section. If part of the body of the fluke such as the bulb breaks this constraint, when in the anchor's proper setting attitude the tip may be lifted clear of the seabed and thereby performance would be adversely affected or nullified completely.

Ballast formed by the shaping of bulb 55 moves the ballast downward and away from the anchor's center of mass when compared to a typical "V" form anchor. Although the shift in position is relatively small shifting the entire weight of the anchor even a small distance can lead to a substantially improved performance. This improves the leverage the effect of the ballast in use.

In the preferred form of the invention the flange 50 is positioned to be approximately parallel to the seabed surface 52 when in contact with it, or curved a little up and away to produce a convex surface. This shape provides the optimal resistance to sinking upon the anchor 1 first contacting the surface 52.

This is achieved by identifying the contact point on the shank 2 and the contact point on the back edge of the fluke 2 for any given attitude where the anchor is lying upside-down or sideways. These contact point pairs may then be joined by imaginary lines which when extended past the back edge of the fluke 2 form the profile lines for the optimal flange 50 surface. The flange 50 may then be extended around the width of the rearward edge 7 of the fluke 2 until it meets the parts of the flange 50 on the side edges 8 and 9 of the fluke 2 which form in use skids 54 on the sides of the fluke 2 and is merged into skids 54 to form a single surface.

The fluke may feature a hole 60 positioned directly behind the shank in order to allow the passage of the rode for a tandem anchor which may be attached to the appropriate point 61 on the shank 2. Hole 60 is substantially in line with an imaginary line 62 drawn from the rode attachment point 25 and the tandem anchor attachment point 61, and also approximately at the center of effort of the fluke 2. This arrangement permits forces from the primary and tandem rodes together with the reaction force from the anchor's holding effect to be as collinear as possible when a tandem anchor is in use, keeping the forces on the anchor in the correct balance for optimal performance.

Advantages

An anchor is provided in which at least in the preferred form has the advantages that the anchor can resist forces particularly when retrieving the anchor in a satisfactory manner. Also bending forces on the fluke are resisted to a substantial degree.

The anchor shank and fluke are both configured to achieve optimal performance and increased efficiency. The shank and fluke are both optimized for effective setting and the fluke surface area is able to be maximized without significant detriment to strength.

The anchor may roll to the correct attitude for use in a satisfactory manner in use even on soft seabeds.

The smooth curvature of the concave faces in the shank allow enhanced soil flow during setting of the anchor in use and improved stress distribution for lateral loading.

Variations

It will of course be realized that while the foregoing has been given by way of illustrative example of this invention, all such and other modifications and variations thereto as would be apparent to persons skilled in the art are deemed to fall within the broad scope and ambit of this invention as is hereinbefore described.

What I claim is:

1. An anchor including a shank, the shank in transverse cross section along at least part of the length of the shank having a forward facing edge, a rearward facing edge and a pair of side faces between the forward facing edge and the rearward facing edge, the parts of the shank adjacent the forward facing edge being substantially v shaped in cross section and at least part of the side faces between the substantially v shaped part and the rearward facing edges having a concave face along the length of each side face, and each concave face having no substantial change of curvature in a direction substantially transverse to the length of the shank.

2. An anchor as claimed in claim 1 wherein the v shape and the concave parts extend substantially the full length of the shank and wherein the v shaped part extends inwardly of the shank substantially one third of the width of the shank.

3. An anchor as claimed in claim 1 wherein the concave parts of the side faces are positioned so that the shank between the substantially v shaped part and the rearward facing edge is substantially in the form of an I beam along at least a substantial part of the length of the shank.

4. An anchor as claimed in claim 3 wherein the I beam has an inner arm and an inner face, wherein the inner arm of the I beam tapers towards its extremity, the inner face of the I beam tapers to a substantially nil height, and the edge of the shank formed by the point of the substantially v shape is substantially sharp or is radiused.

5. An anchor as claimed in claim 1 wherein the anchor has a shank, the shank having a base and a rode-attachment end, wherein the base of the shank or a section near it is generally thicker than the rode-attachment end, said thickness varying between the two ends forming an approximately linear taper, and the profile of the base of the shank is higher than the rode-attachment end, said height varying between the two ends forming an approximately linear taper.

6. An anchor as claimed in claim 1 wherein attachment points are formed by holes penetrating the shank from side-to-side and said holes are surrounded by a section of shank the thickness of which is equal to the maximum width of the shank profile at that point in the shank's length.

7. An anchor including a fluke having a forward end, a pair of side edges and a rearward edge in use, and a continuous flange extending from at least one part of one side edge across the rear edge and onto at least part of the other side edge, the anchor further having a shank, the shank having a substantially forward facing edge and a substantially rearward facing edge in use, the flange and the shank each being curved along their length such that in use the shank and flange co-operate to allow the anchor to rotate about the flange and at least parts of the rearward facing edge, the angle between the flange and the fluke at their intersection being between substantially 60° and substantially 120°.

8. An anchor as claimed in claim 7 wherein the fluke includes side edges between the rearward edge and the forward end, the flange extending onto the side edges, and skids being provided on both sides of the back side edges of the rearward edge of the fluke at an angle between a range of 70 and 110 degrees to the surface of the fluke at the location where the skids meet the rearward edge of the fluke.

9. An anchor as claimed in claim 7 wherein the fluke has the upper surface thereof forming a generally concave triangular spoon shape, with the point of the triangle facing forward and the section of the fluke adjacent the point of the triangle having an average thickness of which is greater than the average thickness of fluke adjacent the rearward end of the fluke, and the rear of the rearward edge of the fluke being curved or bent upward.

10. An anchor as claimed in claim 7 wherein each side of the back edges of said fluke possess a quasi-elliptical or circular convex profile, and the center of said back edge is located at a point extended behind the sides of the fluke, and a flange is attached to the back of said fluke, said flange extending substantially around the width of the fluke, and a shank, wherein the upper edge of said shank forms a compound curve extending away from a line between the base of the shank and the rode attachment point, along which said flange and said shank edge the anchor may roll if positioned on a flat surface in an upside-down or sideways attitude, said surface always only in contact with one point on said flange and one point of said shank edge such that the relative position of the anchor's center of mass will cause the anchor to rotate until its tip is also in contact with said surface.

11. An anchor as claimed in claim 7 wherein the flange consists substantially of a surface formed by numerous profiles of angles selected from a range of angles, when said anchor rests in use on a seabed, said profiles being coplanar to the seabed or curving away from the seabed and forming an average angle of incidence with the seabed in a range of 0 to 30 degrees when the anchor is in such a position that the seabed is in contact with the given profile and the upper edge of the shank.

12. An anchor as claimed in claim 7 wherein the fluke has forward and rearward ends in use and is substantially triangular in shape, the fluke having upper and lower surfaces, the upper surface being substantially concave in transverse cross section and the shank extending from the upper surface, the fluke having a downwardly extending bulb on the lower surface positioned at or towards the forward end to provide ballast to the anchor forming a geometry that allows the center of mass of the anchor to be lowered in normal use of the anchor, as far as possible.

13. An anchor as claimed in claim 12 wherein said fluke has a downwardly extending part and said bulb is formed by concavities placed on both sides of the downwardly extending part, which concavities extend substantially along the length of said downwardly extending part.

14. An anchor as claimed in claim 7 wherein the fluke has a tip ballast contained within a volume formed on each side of the fluke by a line extending from the tip of the fluke to the outer most extremity of one side of the fluke, the underside front edge of the fluke being at a selected angle to maximize both setting performance and strength, the angle being between substantially 15 and substantially 40 degrees from the line of the top center of the fluke's front section, and said line of the top center of the fluke's front section.

15. An anchor having a fluke, the fluke having an upper surface, a lower surface, a central axis, and a roll bar positioned substantially above the upper surface of the fluke, the roll bar forming a semi-circular or elliptical wheel spanning the maximum width of the fluke and having upper and lower sections, and wherein along at least a substantial part of its length the roll bar is in cross section substantially in the form of a foil or wing, the foil or wing having a leading edge and a trailing edge with the chord of said foil or wing passing through said leading edge and said trailing edge and said chord being angled within 40 degrees of parallel to the central axis of the fluke.

16. An anchor as claimed in claim 15 wherein the foil or wing has two surfaces having different radiuses of curvature, the surface of the foil or wing having the greater radius of curvature facing the fluke.

17. An anchor as claimed in claim 15 wherein the fluke has a forward end, a rearward end, a lower surface, an upper surface, and a pair of side edges, a rib substantially longitudinal of the fluke on the lower surface of the fluke, and the fluke being substantially concave between the rib and the side edges along at least a substantial part of the length of the rib, the rib extending from the forward end of the fluke towards the rearward end of the fluke for at least one half of the length of the fluke.

18. An anchor as claimed in claim 15 wherein the fluke has a section of deepened profile extending from the forward end of the fluke to a position substantially two-thirds of the length of said fluke, or alternately to such a length that it extends just past the rear extremity of the base of the shank attached above to the upper surface of said fluke.

19. An anchor as claimed in claim 15 wherein the lower surface of the fluke has a rebate extending from the rearward end to a position between the forward end and the rearward end, the rebate extending substantially one third of the length of the fluke and the rebate extending over substantially the full width of the fluke.

* * * * *